US008012070B2

(12) United States Patent
James et al.

(10) Patent No.: US 8,012,070 B2
(45) Date of Patent: Sep. 6, 2011

(54) PORTABLE MOUNTABLE UPPER-BODY EXERCISE DEVICE

(75) Inventors: Joanne G. James, Miami Beach, FL (US); Mary P. Moschos, Fort Lauderdale, FL (US); Neal Rosenblum, Hollywood, FL (US); Stephen B. Douglas, Boxborough, MA (US)

(73) Assignee: Jamos LLC, Fort Lauderdale, FL (US)

( * ) Notice: Subject to any disclaimer, the term of this patent is extended or adjusted under 35 U.S.C. 154(b) by 0 days.

(21) Appl. No.: 12/548,139

(22) Filed: Aug. 26, 2009

(65) Prior Publication Data

US 2010/0056348 A1 Mar. 4, 2010

Related U.S. Application Data

(60) Provisional application No. 61/190,160, filed on Aug. 26, 2008, provisional application No. 61/175,722, filed on May 5, 2009.

(51) Int. Cl.
*A63B 21/012* (2006.01)

(52) U.S. Cl. ..... 482/114; 482/904

(58) Field of Classification Search ..... 482/122, 482/127, 129, 907, 114, 115, 904; 81/58.4, 81/63.1; 280/47.36, 47.371; 403/148, 149
See application file for complete search history.

(56) References Cited

U.S. PATENT DOCUMENTS 2,921,791 A * 1/1960 Berne ..... 482/118
3,013,799 A * 12/1961 Wise ..... 482/118
4,585,363 A * 4/1986 McGuire ..... 401/6
4,618,139 A * 10/1986 Haaheim ..... 482/70
5,207,622 A 5/1993 Wilkinson et al.
5,242,179 A 9/1993 Beddome et al.
5,244,446 A * 9/1993 Engel et al. ..... 482/137
5,507,712 A * 4/1996 Chang ..... 482/126
5,540,641 A * 7/1996 Williams et al. ..... 482/114
5,674,165 A * 10/1997 Cohen et al. ..... 482/127
5,709,630 A 1/1998 Froelich, Sr. et al. ..... 482/46
5,720,702 A * 2/1998 Lee ..... 482/129
5,803,874 A * 9/1998 Wilkinson ..... 482/54
6,098,492 A * 8/2000 Juchniewicz et al. ..... 74/551.3
(Continued)

OTHER PUBLICATIONS

International Searching Authority, Partial International Search Report, dated Apr. 2, 2010, Application No. PCT/US2009/055058, 7 pages.

*Primary Examiner* — Allana Lewin
(74) *Attorney, Agent, or Firm* — Sunstein Kann Murphy & Timbers LLP

(57) ABSTRACT

An exercise apparatus includes a handle bar and a resistance assembly, coupled to the handle bar. The resistance assembly includes a housing having first and second opposed parts, and permitting movement of the handle bar about a rotational axis upon applying force to the handle bar. A resistance mechanism resists movement of the handle bar about the rotational axis. A screw, mounted lengthwise along the rotational axis, and engaging a threaded receptacle, adjustably compresses the spacing between the housing parts and modifies resistance to movement of the handle bar. One of the screw and the receptacle is coupled to an adjustment knob setting a user-defined resistance. A clamp, coupled to the housing, removably attaches the exterior of the first housing part to a member. A user grasps the handle bar and moves it by applying force corresponding to the resistance setting. The clamp can be utilized without operating the knob.

21 Claims, 16 Drawing Sheets

U.S. PATENT DOCUMENTS 6,196,947 B1 3/2001 Anderson
6,482,138 B1 * 11/2002 Nelson ..... 482/118
6,652,428 B2 * 11/2003 Meller et al. ..... 482/122
7,223,215 B2 * 5/2007 Bastyr ..... 482/115
2002/0142898 A1 * 10/2002 Willis et al. ..... 482/130
2003/0216229 A1 * 11/2003 Bastyr ..... 482/115

* cited by examiner

PORTABLE MOUNTABLE UPPER-BODY EXERCISE DEVICE

The present application claims priority from U.S. Provisional Applications Nos. 61/190,160, filed Aug. 26, 2008, and 61/175,722, filed May 5, 2009, the full disclosures of which are hereby incorporated by reference herein.

TECHNICAL FIELD

The present invention relates to exercise devices, and more particularly to upper-body exercise devices capable of being mounted in a variety of locations.

BACKGROUND ART

It is known in the prior art to provide an upper-body workout with various exercise machines. It is recognized that sometimes it is desirable to provide an upper-body workout under circumstances that preclude the use of most traditional exercise machines. To this end, exercise devices have been created to allow exercising the upper-body while simultaneously engaging in other activities such as pushing a child in a stroller or walking on a treadmill. Such devices tend to become cumbersome and get in the way, however, when the user does not wish to perform an upper-body workout, and it is desirable to be able to remove the portion of the apparatus used solely for exercising the upper-body and reattach it at a later time. Users of such devices also will from time to time want to perform different activities while retaining the ability to achieve an upper-body workout. For example, a user may wish to work out while pushing a stroller at one time, but work out on a treadmill at another time, while being able to work the upper-body in both circumstances. Alternatively, a user may wish to use one stroller one day, but at a later date will have to switch strollers, e.g. to a larger stroller because the child has grown too large for the old stroller, or to a smaller stroller because the user and the child may be traveling to a sporting arena that only allows visitors to bring smaller strollers that can be folded an placed under a seat. In these situations, devices of the prior art are less desirable, because they do not tend to allow for optimum ease of removal and remounting of the exercise device in a new location. Removal or remounting may be impractical for the average user, or at best will require too much time and effort or may require special tools. In some cases, such as the exercise device for use with a stroller shown in U.S. Pat. No. 5,674,165, removal and remounting may even require partial disassembly and reassembly of the resistance mechanism, meaning that the user's carefully calibrated resistance settings will be lost.

SUMMARY OF THE INVENTION

In a first embodiment of the invention is provided an exercise apparatus. The exercise apparatus includes a handle bar and a resistance assembly, coupled to the handle bar and including a housing having first and second opposed parts, each part having an inner face and an exterior, the resistance assembly permitting rotational movement of the handle bar about a rotational axis upon the application of a force to the handle bar. The exercise apparatus also includes a resistance mechanism configured to resist rotational movement of the handle bar about the rotational axis and a screw, mounted so as to have a long axis coinciding with the rotational axis, and engaging with a threaded receptacle, for adjustably compressing the spacing between the inner faces and modifying resistance of the resistance mechanism to the rotational movement of the handle bar, one of the screw and the receptacle being coupled to an adjustment knob by which may be provided a user-defined resistance setting of the force required to cause rotational movement of the handle bar. The exercise apparatus also includes a clamp, coupled to the housing, that removably attaches the exterior of the first part of the housing to a member, such that a user desirous of exercise can grasp the handle bar and cause motion of the handle bar about the rotational axis by applying to the handle bar the force corresponding to the resistance setting and the clamp can be utilized without operation of the adjustment knob.

In a related embodiment, the adjustment knob is mounted to project from the exterior of the second part of the housing.

In another related embodiment, the resistance mechanism includes at least one rotating disc disposed between the inner faces of the first and second parts. The handle bar is coupled to the second housing part, and the at least one disk resists movement of the second housing part relative to first housing part.

In a further related embodiment, the resistance mechanism includes a plate disposed between the inner faces of the first and second parts, and the handle bar is coupled to the plate.

In another related embodiment, the clamp includes an opposed pair of vee blocks, so as to accommodate a range of shapes and dimensions of the member.

In yet another related embodiment, the clamp includes a pair of opposed blocks, a first one of which is a vee block and a second one of which has a smooth concave shape, so that the blocks together define an aperture in which the member can be clamped, so as to accommodate a range of shapes and dimensions of the member.

Alternatively, or in addition, the vee block has a notch depth that is greater than a concavity depth of the second block.

As another alternative, or in addition, the exercise apparatus also includes a hinge connecting the pair of blocks at a first end, and a screw connecting the pair of blocks at a second end.

In a related embodiment, the exercise apparatus also includes an overcenter latch. In a related embodiment, the overcenter latch can be coupled to hold the pair of vee blocks in place.

In another related embodiment, the handle bar has a longitudinal axis and includes an axially divergent end portion. The handle bar is engagable with the movable portion of the housing over a range of angular orientations about the longitudinal axis, so as to provide a selectable angular orientation of the end portion for being grasped by the user.

Alternately, or in addition, the handle bar is removably engagable with the resistance assembly.

In another embodiment of the invention is provided an exercise apparatus including a housing. The housing includes first and second opposed parts, each part having an inner face and an exterior. The exercise apparatus also includes a clamp, coupled to the housing, that removably attaches the exterior of the first part of the housing to a member, and a plate, disposed between the inner faces of the first and second opposed parts, and mounted for rotation about a rotation axis relative to the first and second parts. The exercise apparatus also includes a handle bar, coupled to the plate, that causes the plate to rotate relative to the housing, and a screw, mounted so as to have a longitudinal axis coinciding with the rotational axis, and engaging with a threaded receptacle, for adjustably compressing the inner faces against the plate so as to permit adjustment of resistance offered by the plate against motion relative to the housing, such that a user desirous of exercise can grasp the handle bar and cause the plate to move relative to the housing by applying to the handle bar an amount of force corresponding to the adjustment.

In a related embodiment, the plate comprises a corrosion resistant metal. In a further related embodiment, the plate comprises stainless steel.

In another related embodiment, the inner faces of the opposed parts are composed of plastic. In a further related embodiment, the plastic is a polyoxymethylene. In another related embodiment, the plastic is a polycarbonate.

In another related embodiment, each of the opposed parts includes an eccentric region, and the eccentric regions include components that are interengaged with one another to prevent motion of the first part relative to the second part.

Alternatively, or in addition, the eccentric regions occupy an angular extent of less than 180 degrees, so as to permit motion of the of the handle bar over a range of at least 180 degrees.

In a related embodiment, the exercise apparatus also includes an adjustment knob, coupled to one of the screw and the receptacle, such that adjustment of resistance is achieved by turning the knob.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1:
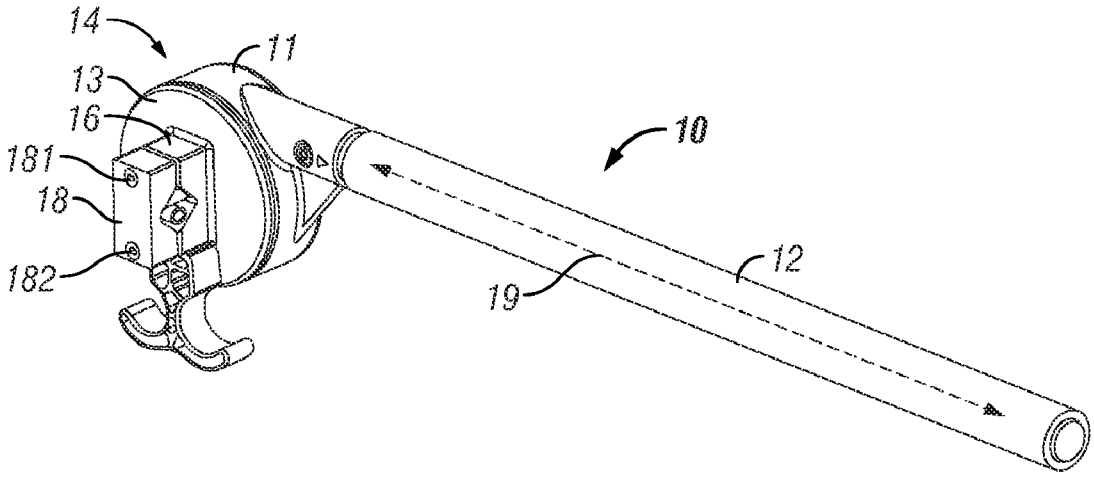
FIGS. 1 and 2 are perspective views of an exercise device according to an embodiment of the present invention, in which the housing is shown as viewed from the side of the first portion and the side of the second portion respectively.
Figure 2:
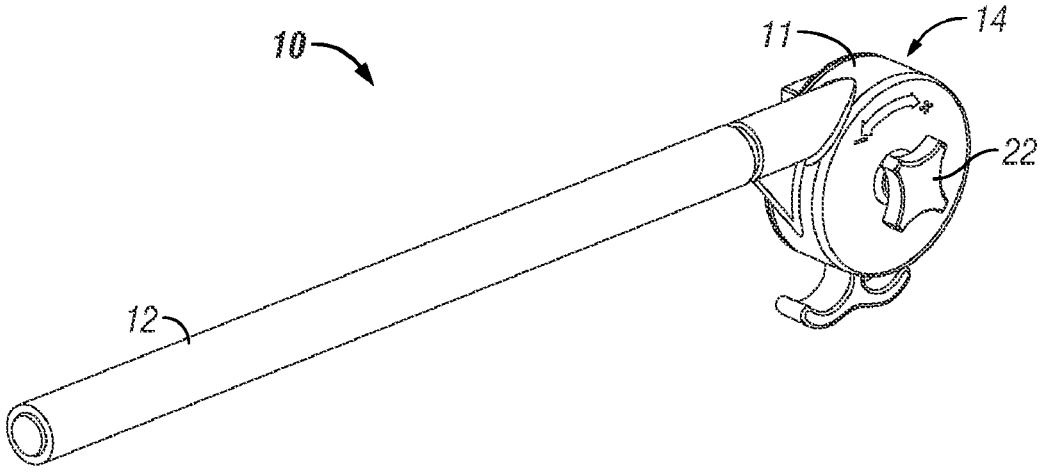

FIGS. 1 and 2 are perspective views of an exercise device 10 according to an embodiment of the present invention, in which a housing 14 is shown as viewed from the side of the first portion and the side of the second portion respectively. In the embodiment shown in FIGS. 1 and 2, the portions of the housing include a fixed portion 13 and a moveable portion 11.

Housing 14 is connected to a handle bar 12. Handle bar 12 is shown as being straight, elongated along a longitudinal axis 19. In an alternate embodiment, illustrated in FIG. 9 and discussed below, handle bar 12 also may be curved, such that it has an end portion 91 that is axially divergent from the longitudinal axis. Optionally, the handle bar is removably engagable with the housing. The handle bar may be rendered removably engagable by a variety of methods known in the art. In one embodiment, the bar may be held in place by a conventional clamp. In another embodiment, the bar may be engaged by threading the end that gets engaged with the housing and providing a mating thread in the housing.

Figure 8:
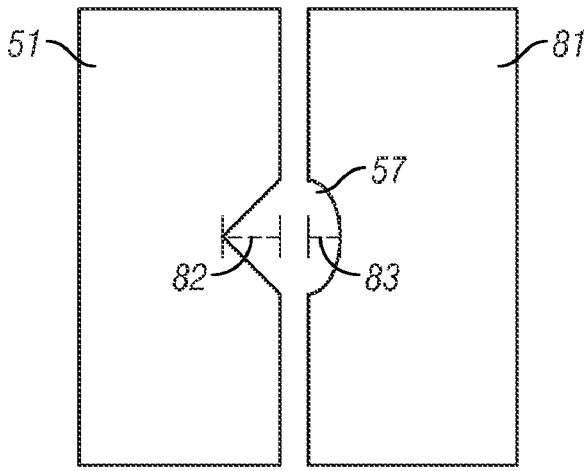
FIG. 8 is a side view of a clamp, associated with another embodiment of an exercise device in accordance with the present invention, for affixation of the embodiment to a member.

In the embodiment shown in FIGS. 1 and 2, housing 14 is substantially cylindrical, having two relatively flat faces, one face on the fixed portion 13 of the housing and the other face on the moveable portion 11 of the housing. To the face of the fixed portion 13 is affixed a clamp. As described in further detail below, the clamp can be used to removably attach the device to a member. The clamp shown is implemented using a pair of opposed vee blocks 16 and 18. In an alternate embodiment, illustrated in FIG. 8, one block 81 of the pair of opposed vee blocks may be modified to exhibit a smooth concave shape. Vee block 51 has a notch depth 82, and block 81 has a concavity depth 83 such that notch depth 82 may be greater than concavity depth 83. The blocks together define an aperture 57 in which the member can be clamped. Additionally, modified vee block 81 may have greater dimensions than before modification; for example the cross sectional area of the open portion of modified block 81 may be greater than that before modification. The resulting lack of symmetry exhibited by the opposed blocks assists in accommodating a range of sizes and shapes of members to which the blocks may be clamped. The vee block 16 is affixed to the face of the fixed portion 13 of the housing, and the vee block 18 is made adjustably close to vee block 16 by a pair of screws 181 and 182 that go into vee block 16. These screws can be threaded into vee block 16 or alternatively into the fixed portion 13 of the housing or optionally into a pair of corresponding nuts affixed to the inside of the fixed portion 13 of the housing.

The housing 14 also includes a moveable portion 11 that is moveable with respect to the fixed portion 13. To the moveable portion 11 is coupled handle bar 12, which is disposed parallel to the faces of the cylinder defined by housing 14. The handle bar is moved by a user for exercise as described in further detail below. An adjustment knob 22 is located on the face of the moveable portion 11 of the housing 14. By turning adjustment knob 22, a user can adjust a resistance setting for the exercise device.

Figure 3:
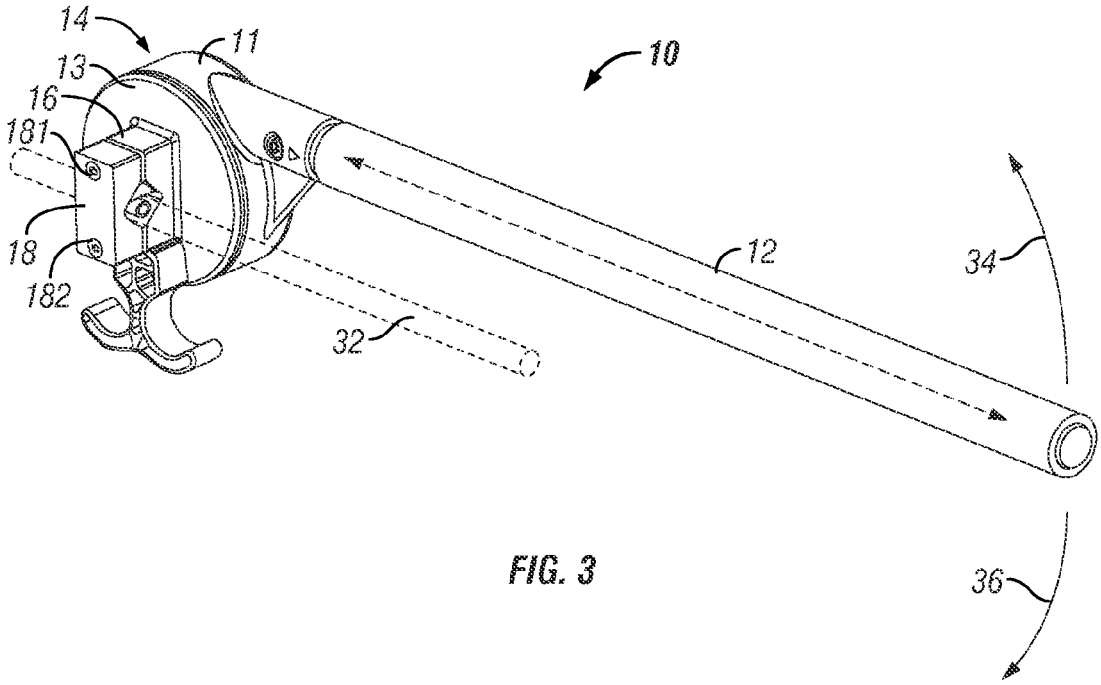
FIG. 3 is a perspective view of the exercise device of FIGS. 1 and 2 mounted on a member according to an embodiment of the present invention.

FIG. 3 is a perspective view of the exercise device of FIGS. 1 and 2 mounted on a member 32. The member is preferably of such a nature that when exercise device 10 is mounted on member 32, a user may comfortably grasp handle bar 12 and exercise by causing handle bar 12 to move forward 34 and backward 36, pivoting about a rotational axis that coincides with the central axis of the cylinder defined by housing 14. The user causes handle bar 12 to move by applying sufficient force to overcome an amount of resistance to motion of the handle bar set using adjustment knob 22. Vee blocks 16, 18 securely fasten exercise device 10 to member 32.

Various members may be suitable for mounting the exercise device. One example is a frame member of a child's stroller. According to one embodiment, a pair of exercise devices may be mounted on a stroller, such that a user may exercise both arms and simultaneously propel a stroller carrying a child. A similar function is illustrated in U.S. Pat. No. 5,674,165 to Cohen, which is hereby incorporated by reference herein. Another use involves mounting the exercise device on a wheelchair. A person in a wheelchair can attach the present exercise device(s) to a frame member of the wheelchair, allowing the person to perform an upper-body resistance workout at a customized resistance level while sitting in the wheelchair. Another use involves adding an upper-body component to a treadmill workout. While most treadmills do not provide for an upper-body resistance workout, many treadmills have various bars comprising the frame of the treadmill which may be suitable for mounting the present exercise devices to supplement the treadmill workout with upper-body resistance work. Because in various embodiments the clamp is suitable for attaching to members of various sizes, the exercise device may be mounted to such a variety of members.

Because the resistance level can be adjusted, the user may achieve different types of upper-body workouts. A user primarily concerned with strength training and muscle toning may set the resistance to a higher level to provide a workout similar to what would be provided by using a weight machine. Such a mode of operation would be most appropriate for use in a stationary setting, such as by a user sitting in a motionless wheelchair. By setting the resistance to a lower level, on the other hand, a user may provide an aerobic workout for cardiovascular training. Such a mode of operation may be particularly useful in an embodiment involving mounting the exercise device on a stroller. Walking while pushing a stroller already provides some limited cardiovascular workout, and the inclusion of low-intensity, high-repetition resistance training of the upper-body provides an additional element of cardiovascular training that is not available when pushing a conventional stroller.

Other suitable locations where the exercise device may be advantageously mounted include stationary bicycles, arm chairs, shopping carts and the like. It should be noted that embodiments of the present invention can provide a convenient and safe, low-impact workout, making it suitable for use by frail individuals, persons undertaking recuperative physical therapy, elderly persons, and so on. Embodiments of the present invention have the additional advantage that rather than removing the exercise device from the member when not in use, the exercise device may instead conveniently be left attached to the member if the user prefers. The handle bar of the exercise device of such embodiments may be positioned so as to hang by the side of the mounting location, out of the way. (Indeed the resistance adjustment may be tightened to lock the handle bar in position.) If the exercise device is mounted on a stroller, for example, the exercise device may even remain attached when the stroller is folded. The present invention is not limited by the list of configurations mentioned here, and additional configurations will be apparent to those skilled in the art.

Figure 4A:
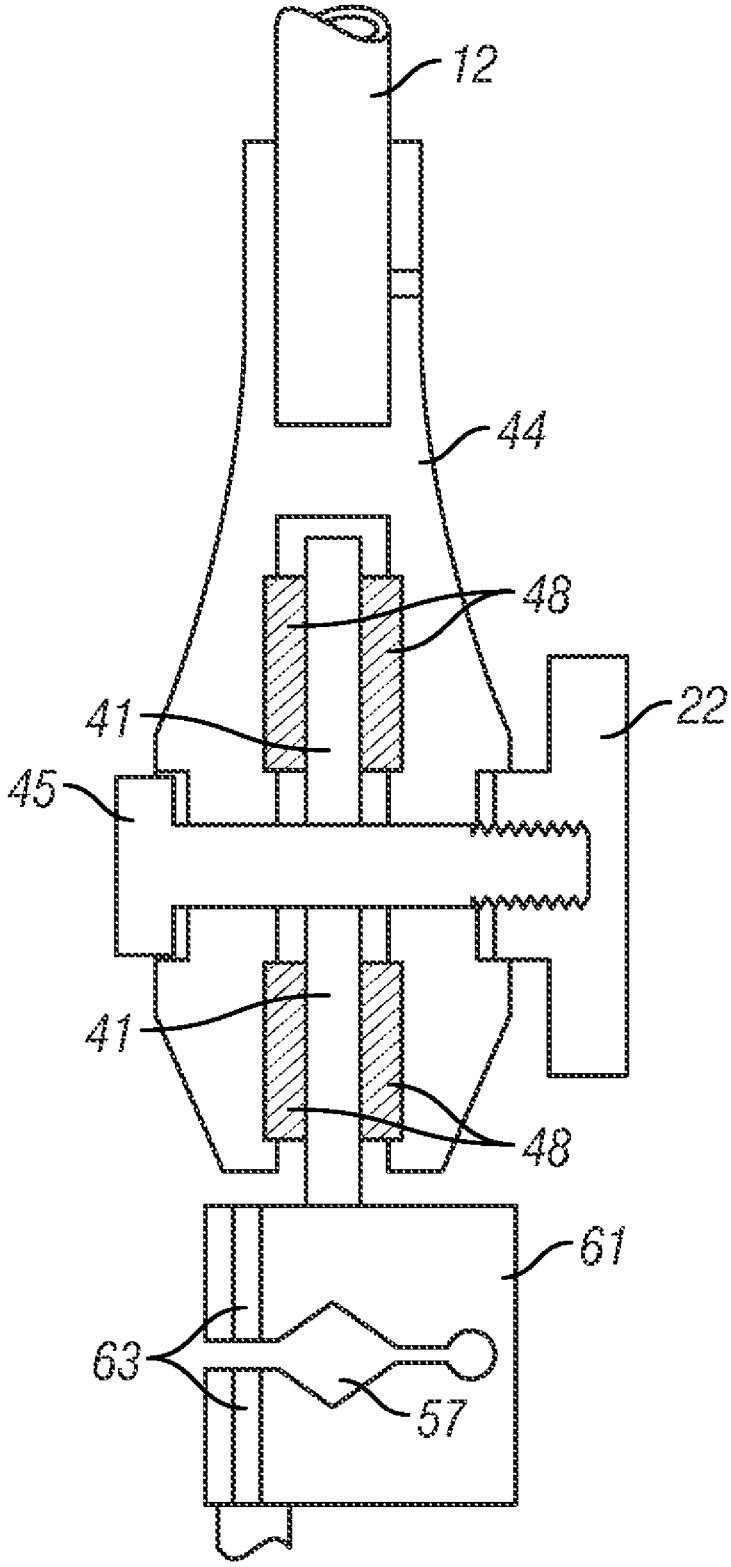
FIG. 4A is a cross-sectional view of a portion of an alternate embodiment of an exercise device.

FIG. 4A is a cross-sectional view of a portion of an alternate embodiment of an exercise device. According to this embodiment, a moveable portion 44 of the housing covers a pair of friction discs 48. Friction discs 48 resist rotational movement of moveable portion 44 relative to a fixed portion 41 of the housing. Fixed portion 41 is situated directly between friction discs 48 and extends outward from moveable portion 44 to a clamp 61 that secures fixed portion 41 to a member. The operation of clamp 61 is similar to the opposing vee block clamp of FIG. 1, but in this embodiment a single piece of material is used. Thus, one end of clamp 61 includes a tunnel 63 through which a screw can pass and hold clamp 61 closed, but the other end of clamp 61 does not require a screw, because the top and bottom vee shapes are connected. Clamp 61 preferably is made from a flexible material, such as polyoxymethylene plastic, so that clamp 61 can flex open to receive a member into a channel 57.

Figure 4B:
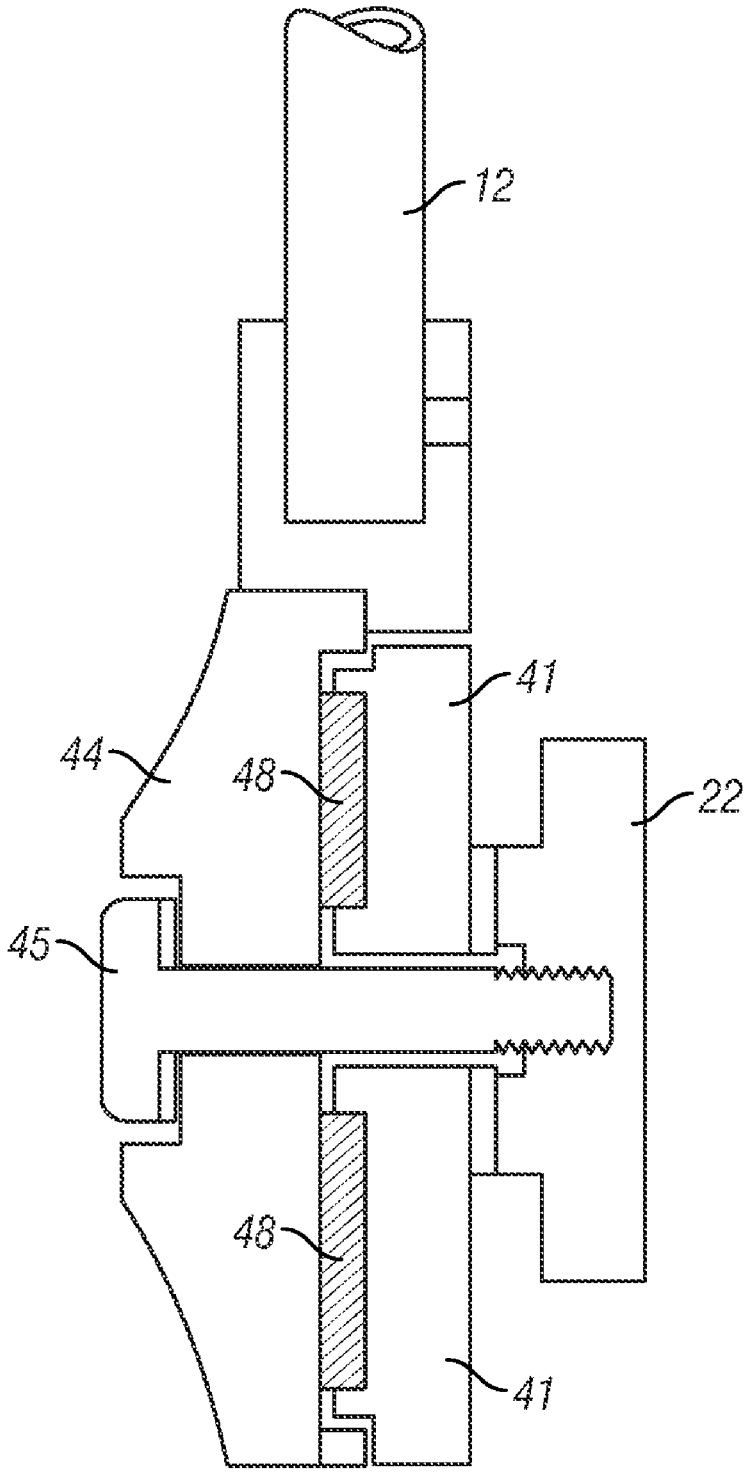
FIG. 4B is a cross-sectional view of a portion of an alternate embodiment of an exercise device.

FIG. 4B is a cross-sectional view of a portion of an alternate embodiment of an exercise device. According to this embodiment, adjustment knob 22 abuts fixed portion 41 rather than moveable portion 44. Additionally, only a single friction disc 48 is used. Friction disc abuts moveable portion 44 on one side, and fixed portion 41 on the other side.

Figure 4C:
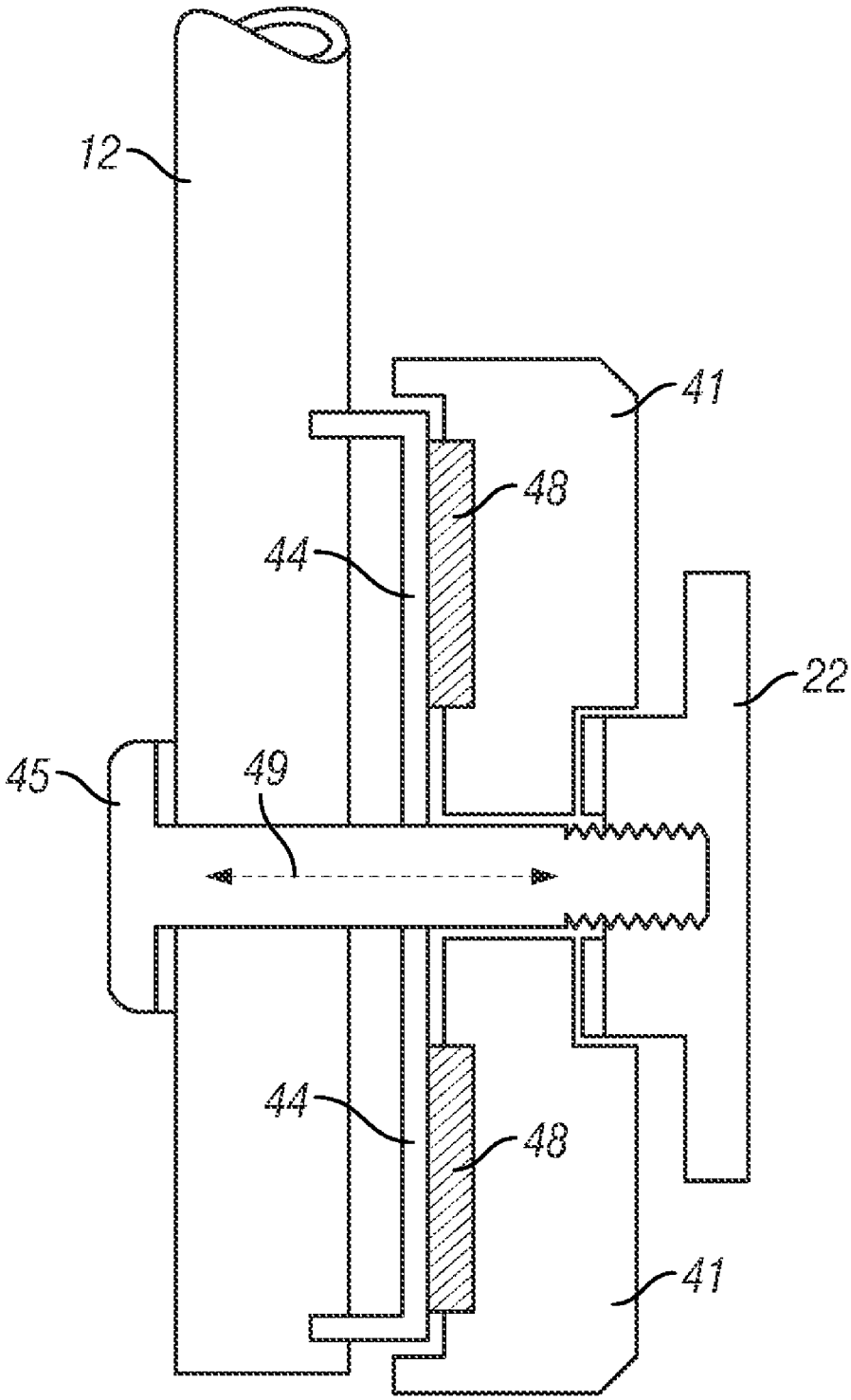
FIG. 4C is a cross-sectional view of a portion of an alternate embodiment of an exercise device.

FIG. 4C is a cross-sectional view of a portion of an alternate embodiment of an exercise device. According to this embodiment, adjustment knob 22 abuts fixed portion 41 rather than moveable portion 44, and a single friction disc 48 is used, as in the embodiment of FIG. 4B. A fixed bolt 45 passes through handle bar 12 along a longitudinal axis 49 in this embodiment. Moveable portion 44 is mounted on the side of handle bar 12.

Figure 5A:
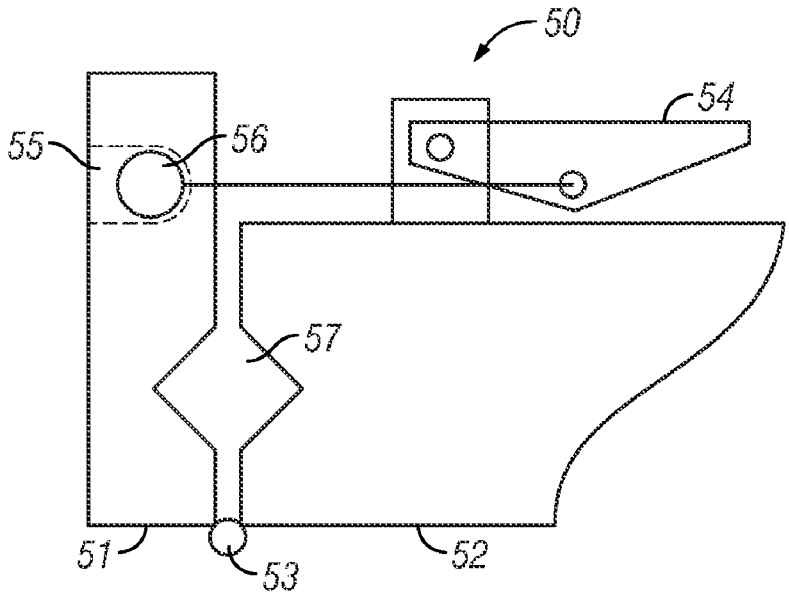
FIG. 5A is a side view of a clamp, associated with another embodiment of an exercise device in accordance with the present invention, for affixation of the embodiment to a member.
Figure 5B:
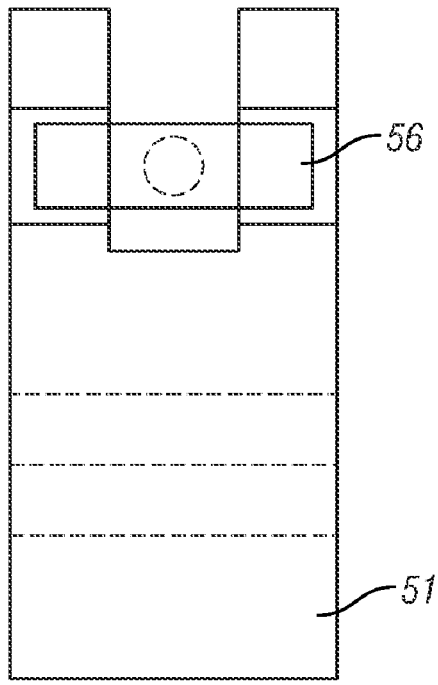
FIG. 5B is a top view of the clamp of FIG. 5A.
Figure 5C:
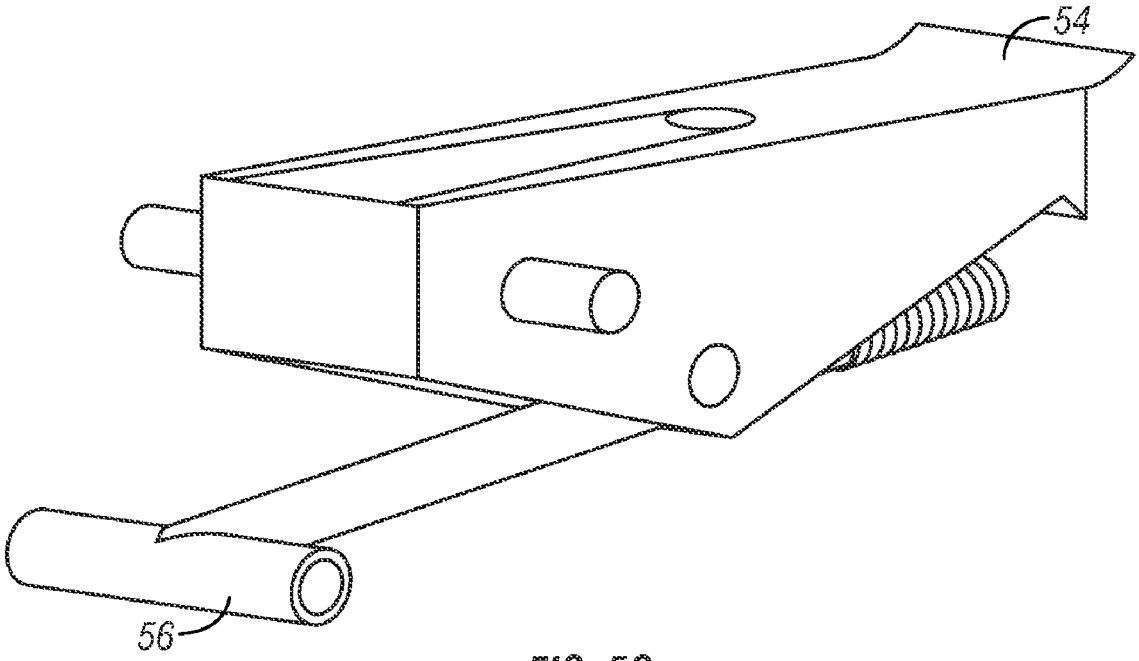
FIG. 5C is a perspective view of the locking mechanism of the clamp shown in FIGS. 5A and 5B.

FIG. 5A is a side view of a clamp, associated with a related embodiment of an exercise device in accordance with the present invention, for affixation of the embodiment to a member. FIG. 5B is a top view of the clamp of FIG. 5A, and FIG. 5C is a perspective view of the locking mechanism of the clamp shown in FIGS. 5A and 5B. In this embodiment, opposing vee blocks 52 and 51 are latched into a tightened position by a draw latch 50, implemented as an overcenter latch, allowing for fast and simple mounting or unmounting of the exercise device. The latch includes a lever 54 coupled to a hook 56. Lever 54 is operatively coupled to vee block 52, which is, in turn, mounted on the housing (not shown). Vee block 51 is coupled to vee block 52 by a hinge 53 such that when the latch is not engaged, vee block 51 can pivot to an open position, allowing the latch assembly to surround a member, such as a shaft, and such that when the latch is engaged, vee block 51 engages vee block 52 forming a channel 57 and the shaft is captured in channel 57. Thus the exercise device becomes mounted to the shaft. The latch is engaged by positioning hook 56 in a groove 55 in vee block 51 while vee block 51 is engaged with vee block 52 and moving lever 54 to a closed position. To unmount the exercise device from the shaft, all that is required is to operate lever 54, allowing hook 56 to disengage from groove 55. At that point, vee block 51 is free to swing open away from vee block 52, at which point the exercise device is no longer mounted on the shaft.

Figure 5D:
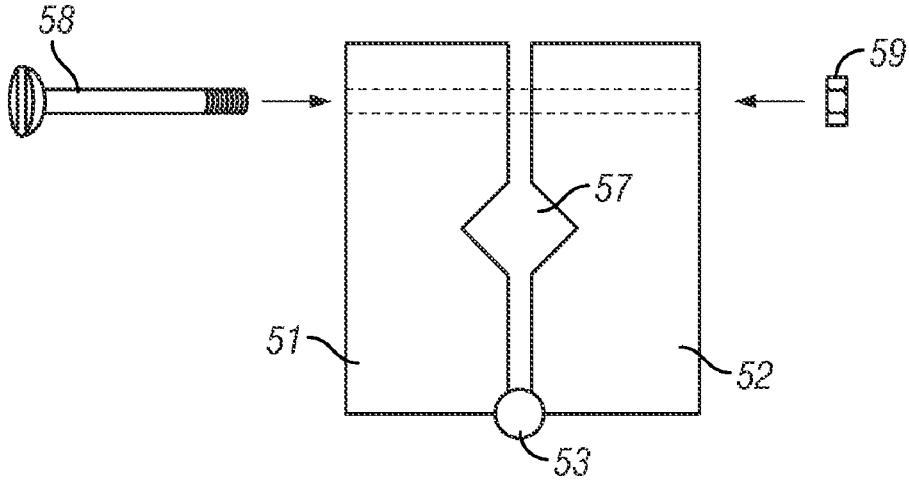
FIG. 5D is a side view of a clamp associated with another embodiment of an exercise device in accordance with the present invention.

FIG. 5D is a side view of a clamp similar to the clamp shown in FIGS. 5A-5C. In this embodiment, a draw latch is not used. Instead, a screw 58 is used to secure opposing vee blocks 51 and 52 in a tightened position. Screw 58 passes through vee blocks 51 and 52 and connects to a nut 59 that holds screw 58 in place. Screw 58 may be a flat-driven screw, as shown, or another suitable threaded fastener as known to those skilled in the art, including, for example, a crosshead or hex socket screw.

Figure 6A:
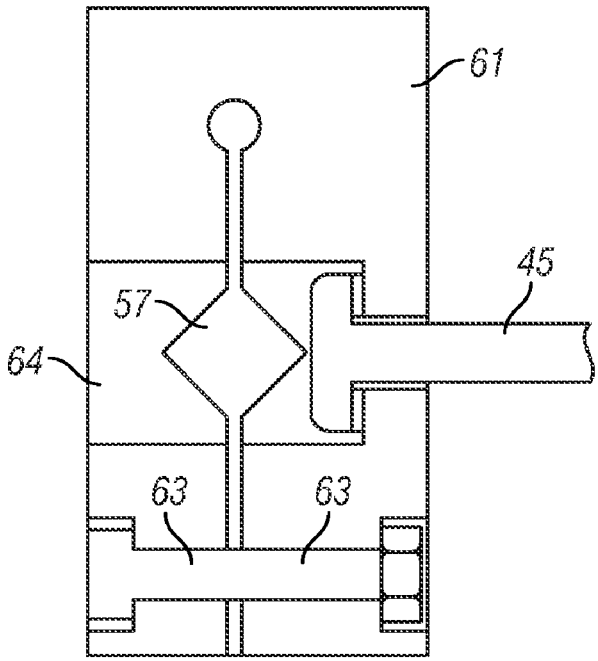
FIG. 6A is a side view of a clamp, associated with another embodiment of an exercise device in accordance with the present invention, for affixation of the embodiment to a member.
Figure 6B:
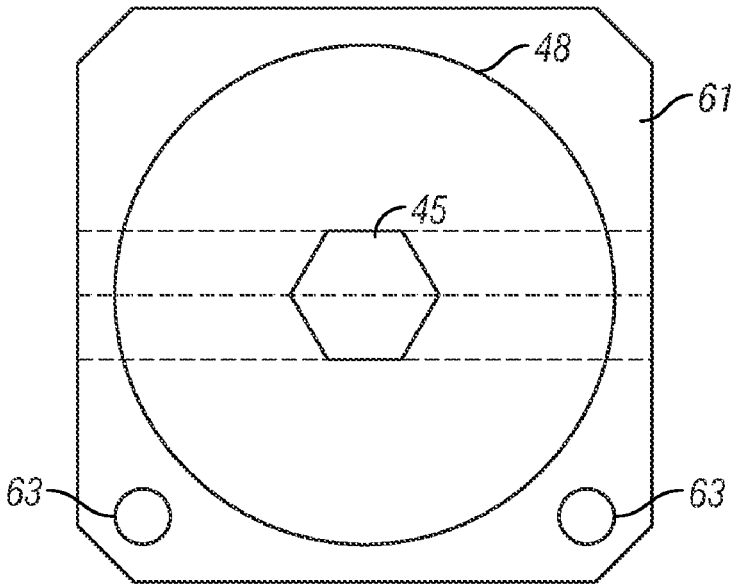
FIG. 6B is a top view of the clamp of FIG. 6A.

FIG. 6A is side view of a clamp, associated with another embodiment of an exercise device in accordance with the present invention, for affixation of the embodiment to a member. FIG. 6B is top view of the clamp of FIG. 6A. The clamp according to this embodiment is similar to the clamp shown in FIG. 4A, but attaches to the housing differently. Fixed bolt 45 is disposed within clamp 61, so that the end of fixed bolt 45 holds clamp 61 against the housing. When the exercise device is first assembled, fixed bolt 45 may pass through an access port 64 in clamp 61 to reach the housing. Clamp 61 also may abut a friction disc 48 on the side of the clamp through which fixed bolt 45 is positioned.

Figure 7A:
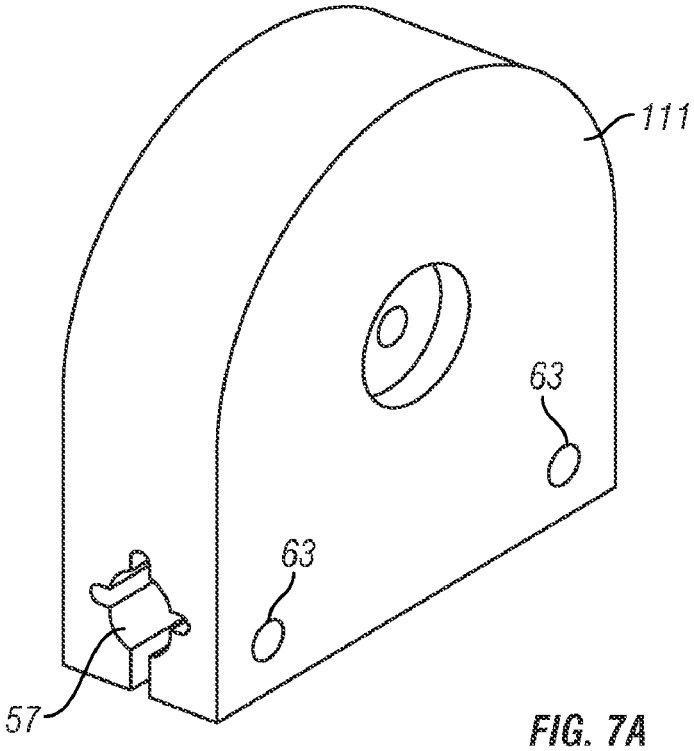
FIG. 7A is a perspective view of a clamp, associated with another embodiment of an exercise device in accordance with the present invention, for affixation of the embodiment to a member.
Figure 7B:
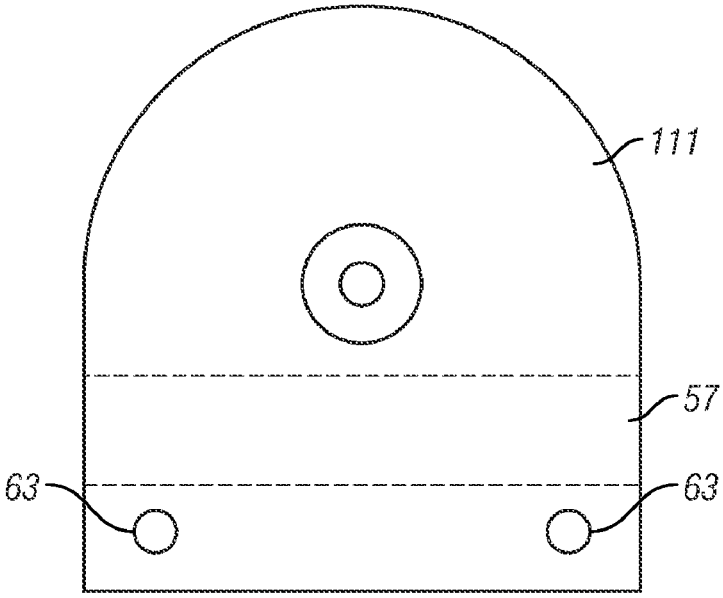
FIG. 7B is a top view of the clamp of FIG. 7A.
Figure 7C:
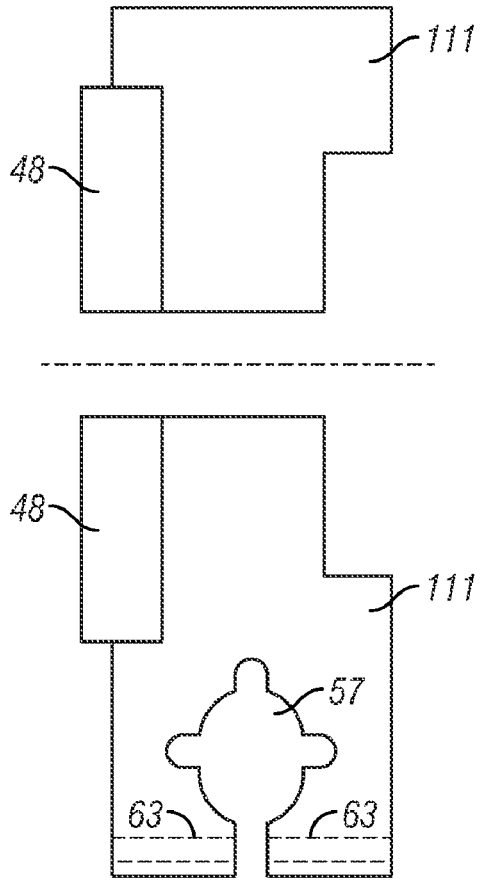
FIG. 7C is a cross-sectional view of the clamp of FIG. 7A.

FIG. 7A is a perspective view of a clamp 111, associated with another embodiment of an exercise device in accordance with the present invention, for affixation of the embodiment to a member. FIG. 7B is a top view of the clamp of FIG. 7A, and FIG. 7C is a cross-sectional view of the clamp of FIG. 7A. According to this embodiment, clamp 111 also performs the function of the fixed portion of the housing of the exercise device. Clamp 111 preferably is made from a flexible material, such as polyoxymethylene plastic, so that clamp 111 can flex open to receive a member into channel 57. It is preferable to choose a material, such as polyoxymethylene, that reduces or eliminates operating noise of the exercise device resulting from friction during motion of the handle bars. Screws may then be inserted in tunnels 63 to hold clamp 111 closed. One side of clamp 111 may then abut friction disc 48. Other parts of the exercise device, such as the moveable portion of the housing, can then be attached to clamp 111 using a fixed bolt disposed through the hole in the middle of clamp 111 as in other embodiments.

Figure 9:
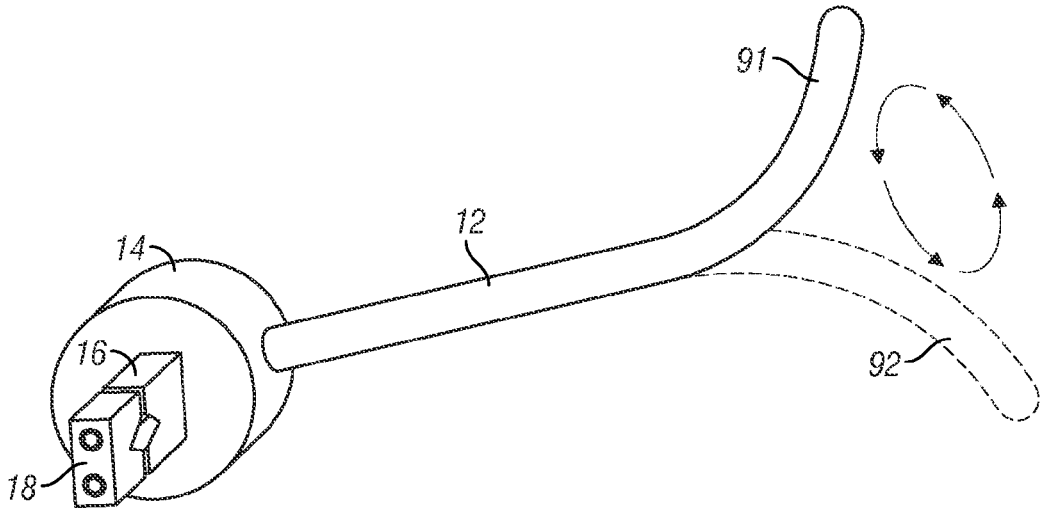
FIG. 9 is a perspective view of an exercise device according to an embodiment wherein the handle bar has a longitudinal axis and includes an axially divergent end portion.
Figure 10:
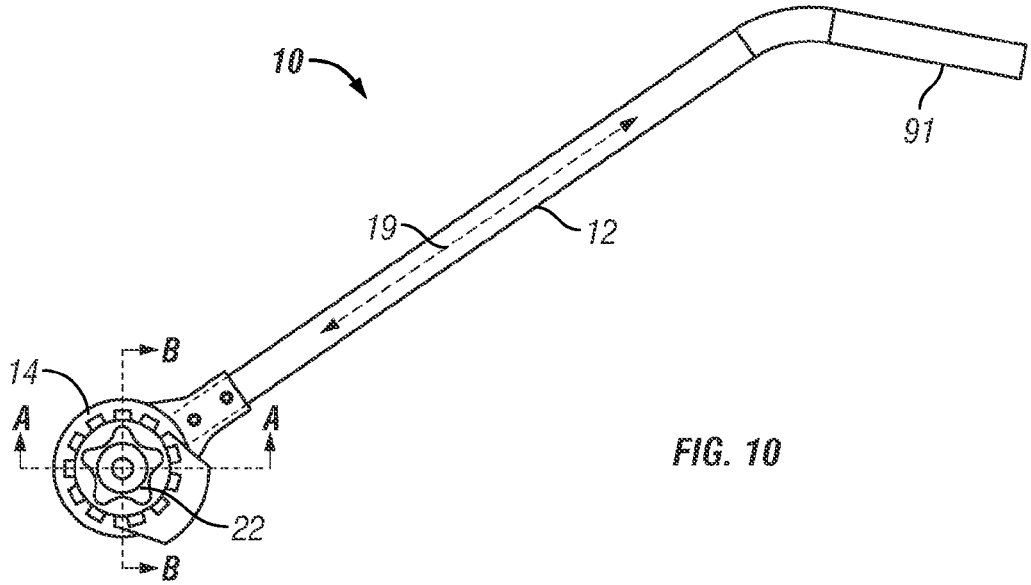
FIG. 10 is a side view of an exercise device according to another embodiment wherein the handle bar has a longitudinal axis and includes an axially divergent end portion.

FIG. 9 is a perspective view of an exercise device according to an embodiment wherein the handle bar 12 has a longitudinal axis and includes an axially divergent end portion 91. Another embodiment including an axially divergent end portion is shown in FIG. 10. The longitudinal axis is coincident with the portion of the handle bar other than the end portion 91. In this embodiment, the handle bar is engagable with the movable portion of the housing over a range of angular orientations about the axis, so as to provide a selectable angular orientation of the end portion for being grasped by the user. For example the handle bar 12 is shown engaged with the housing so that the end portion 91 of the bar is aimed upwardly. In this orientation, a user can comfortably grasp the end portions of the handle bars, while the other portions of the handle bars are oriented at a small angle relative to horizontal, meaning that a user using, e.g., a stroller-mounted embodiment, can stand farther back from the stroller than would be practical with axially non-divergent end portions, such that the user is less prone to bumping into the stroller while walking. Such an orientation also provides for an increased degree of control over the stroller due to the substantially horizontal engagement of the handle bars to the stroller. However, in alternative embodiments, the handle bar may be engaged with the housing so that as indicated by the dashed lines, the end portion (here indicated as item 92) may be aimed downwardly. In yet another orientation, the handle bar may be rotated axially, so that it tilts outwardly; or alternatively, tilts inwardly. When oriented outwardly, the handle bar provides a wider grip for the user, such that grasping a pair of the handle bars and moving the handle bars back and forth requires a different amount of effort and exercises a different set of muscles compared to tilting inwardly or, for example, downwardly.

Accordingly, the user can cause engagement of the handle bar in a selected angular orientation. Also, as previously described, optionally, the handle bar is removably engagable with the movable portion of the housing. The functions of providing a selectable angular orientation of the end portion and of rendering the handle bar removably engaged by the movable portion of the housing may be achieved by providing a clamp on the movable portion of the housing. Alternative fixation systems may also be employed, such as a set screw engagable against the inserted end of the handle bar.

Figure 11:
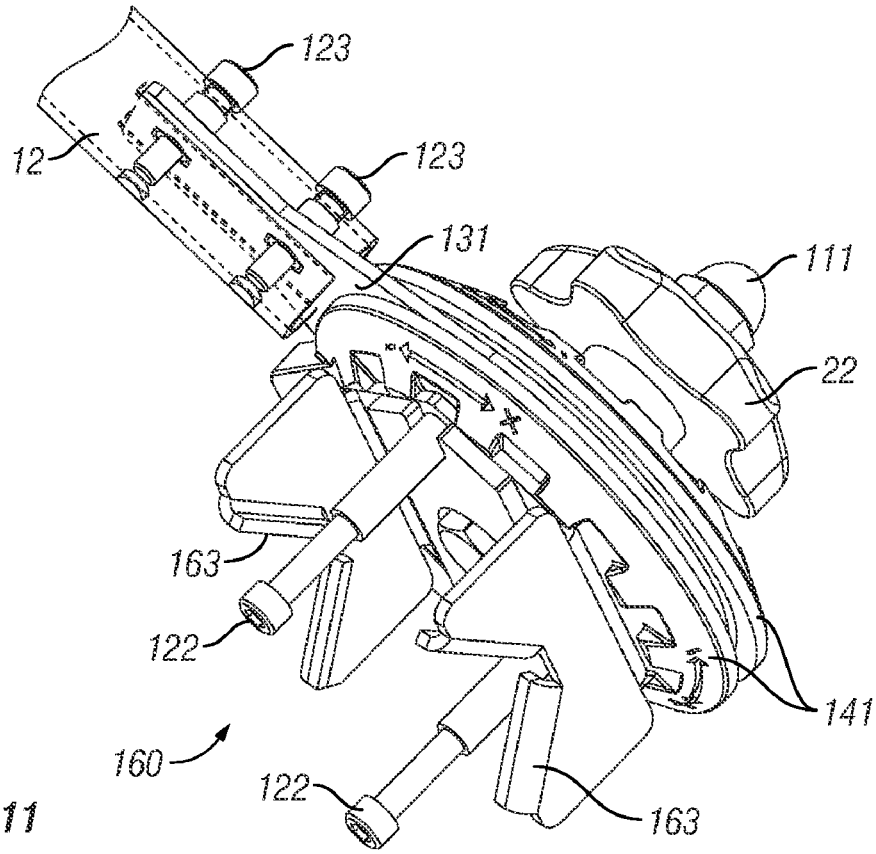
FIG. 11 is a perspective view of the exercise device of FIG. 10.
Figure 15:
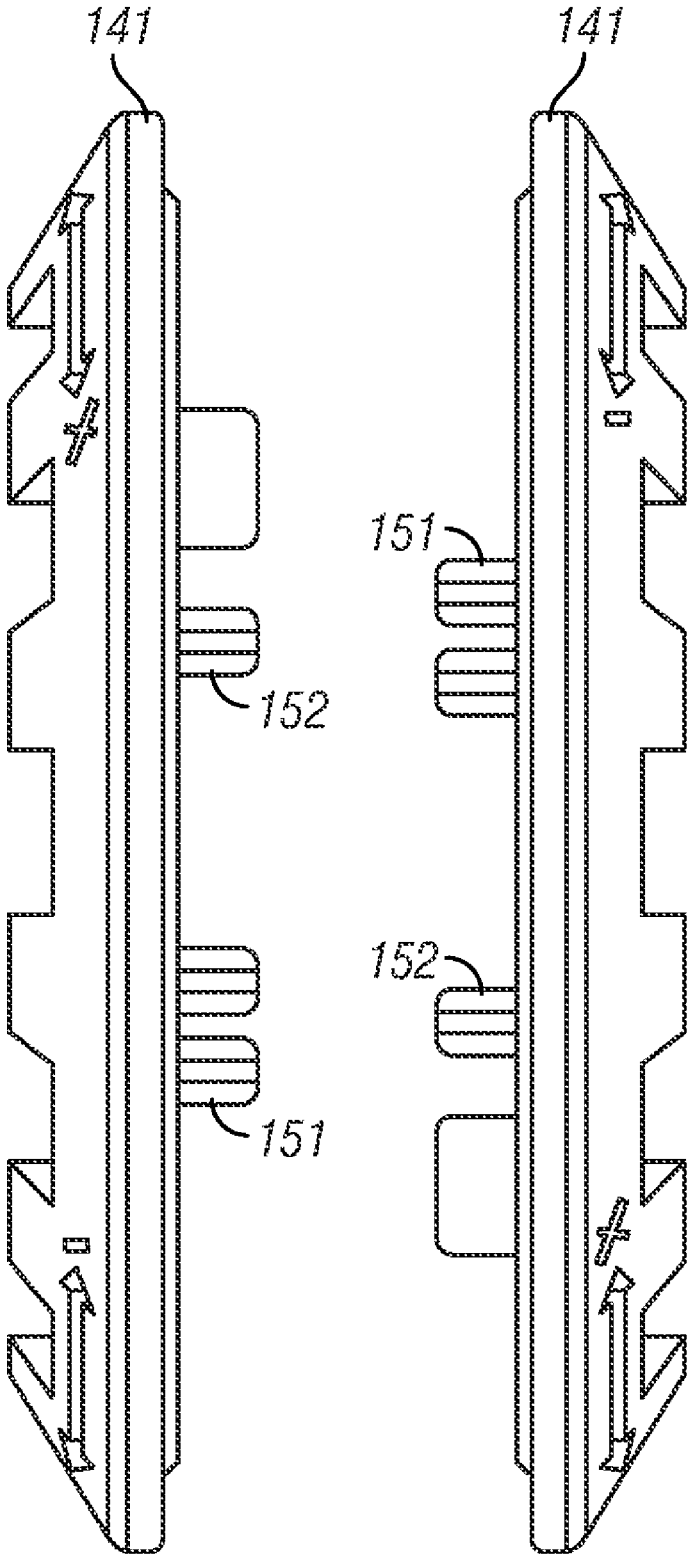
FIG. 15 is a side view of a pair of housing parts associated with the exercise device of FIG. 10.

Another embodiment of an exercise device is now described with reference to FIG. 11, which is a perspective view of the exercise device of FIG. 10, and with reference to FIG. 12, which is a cross-sectional view of the exercise device of FIG. 10. According to the illustrated embodiment, handle bar 12, elongated along longitudinal axis 19, connects directly to a resistance plate 131. A pair of connecting screws 123 connect handle bar 12 to resistance plate 131 at connection sites 133 shown in FIG. 13. Resistance plate 131 may be made advantageously from a corrosion-resistant metal such as stainless steel. The primary portion of resistance plate 131 is disposed between a pair of housing parts 141. Housing parts may be made advantageously from a plastic such as polyoxymethylene or polycarbonate. Housing parts 141 are coupled by mating male interlocking members 152 (shown in FIG. 15) and female interlocking members 151 (shown in FIG. 15). As shown in FIG. 18, male interlocking members 152 and female interlocking members 151 are located in an eccentric portion of housing parts 141. The eccentric location allows housing parts 141 to be coupled without interfering with operation of resistance plate 131 during exercise. Additionally, the connection of the eccentric regions partially limits the angular extent of rotation of the handle bar. In embodiments mounted on a stroller, for example, this limitation prevents the handle bar from dropping onto an occupant of the stroller. In FIG. 10, the eccentric region is shown in a lower right-hand orientation. In a stroller-mounted embodiment, this location would correspond to the front-facing orientation relative to the stroller. The handle bar is prevented from rotating clockwise beyond the illustrated extent, but is allowed to rotate counter-clockwise until the handle bar faces directly downward, e.g. for storage out of the way of a person pushing the stroller. When the exercise device of the illustrated embodiment is in use, housing parts 141 both remain stationary relative to the member to which the exercise device is attached, while resistance plate 131 rotates within and relative to housing parts 141. Because both housing parts 141 do not move relative to each other, no additional torque is applied to adjustment knob 22 relative to fixed bolt 45, such that the position of adjustment knob 22 remains substantially constant relative to fixed bolt 45 during operation of handle bar 12. Friction between housing parts 141 and resistance plate 131 provides resistance to rotational motion of resistance plate 131 relative to housing parts 141 that allows the user operating handle bar 12 to receive an upper-body workout. Fixed bolt 45 passes through housing parts 141, through a hole 132 (shown in FIG. 13) in resistance plate 131 and through adjustment knob 22 into a locking nut 111. Locking nut 111 helps keep the structure of the exercise device intact, by preventing adjustment knob 22 from loosening beyond a predetermined amount, ensuring that housing part 141 and vee-shaped clamp members 163 remain engaged. Rather than abutting housing parts 141 directly, adjustment knob 22 abuts a pressure dispersing plate 121 that disperses the pressure adjusted by adjustment knob to apply the pressure more evenly and at a larger radius to housing parts 141. This arrangement leads to more even resistance and lowered strain on housing parts 141 and higher torque resistance of the handle bar itself. On the opposite side of housing parts 141 relative to adjustment knob 22, a clamp 160 is provided for removably attaching the exercise device to a member. Fixed bolt 45 attaches clamp 160 to housing parts 141. Clamp 160 includes vee-shaped clamp members 163. When a member is disposed against vee-shaped clamp members 163, a clamp plate 172 can be attached by passing clamp screws 122 through clamp plate screw holes 171 (shown in FIG. 17) into clamp hex plate screw holes 162 (shown in FIG. 16) to secure clamp 160 to the member. The clamp plate is absent from the illustration in FIG. 11 for clarity.

Figure 12:
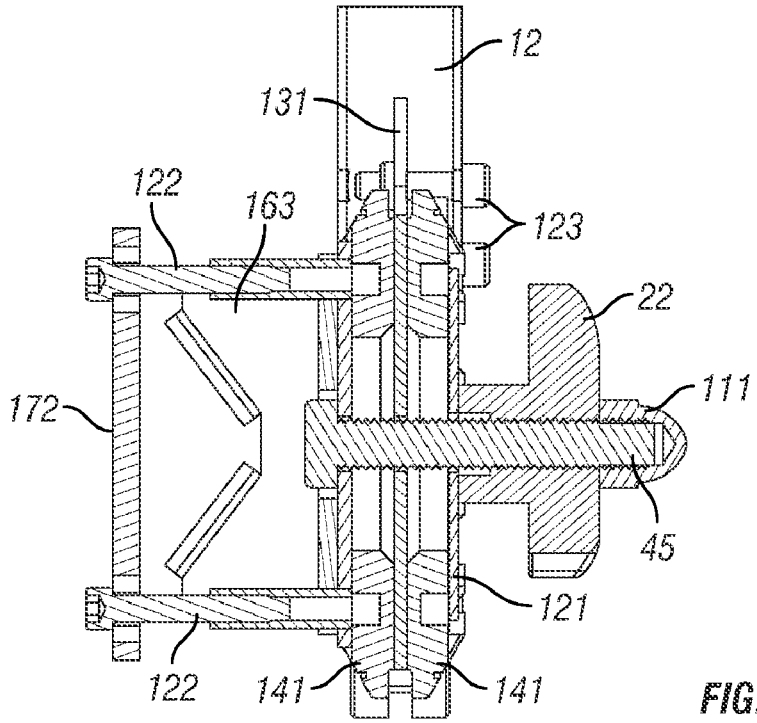
FIG. 12 is a cross-sectional view of the exercise device of FIG. 10.
Figure 13:
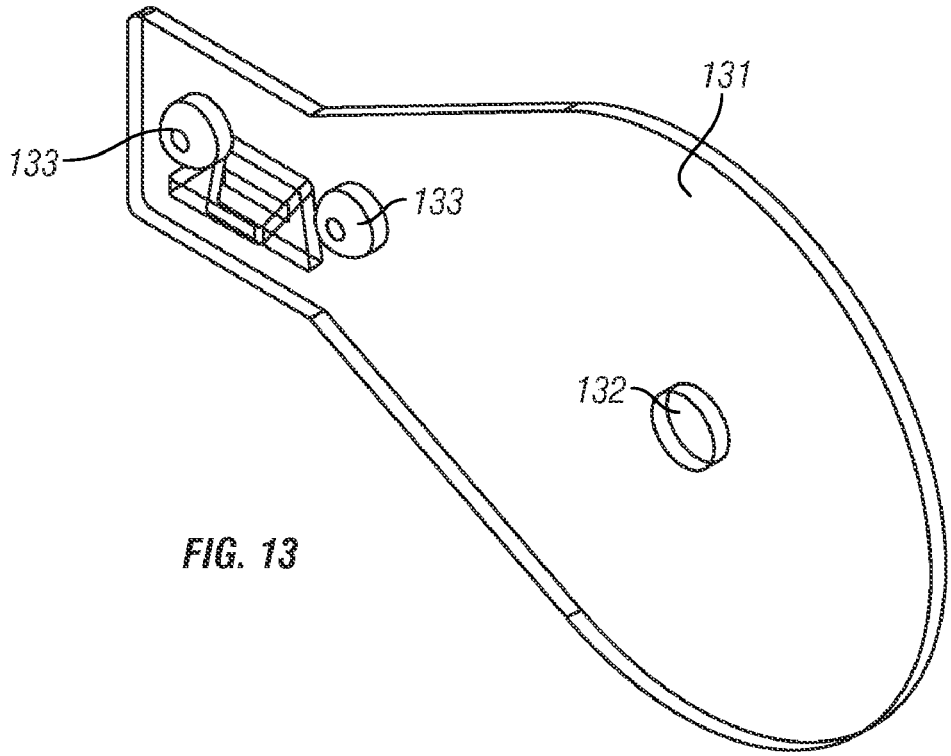
FIG. 13 is a perspective view of a resistance plate associated with the exercise device of FIG. 10.
Figure 14:
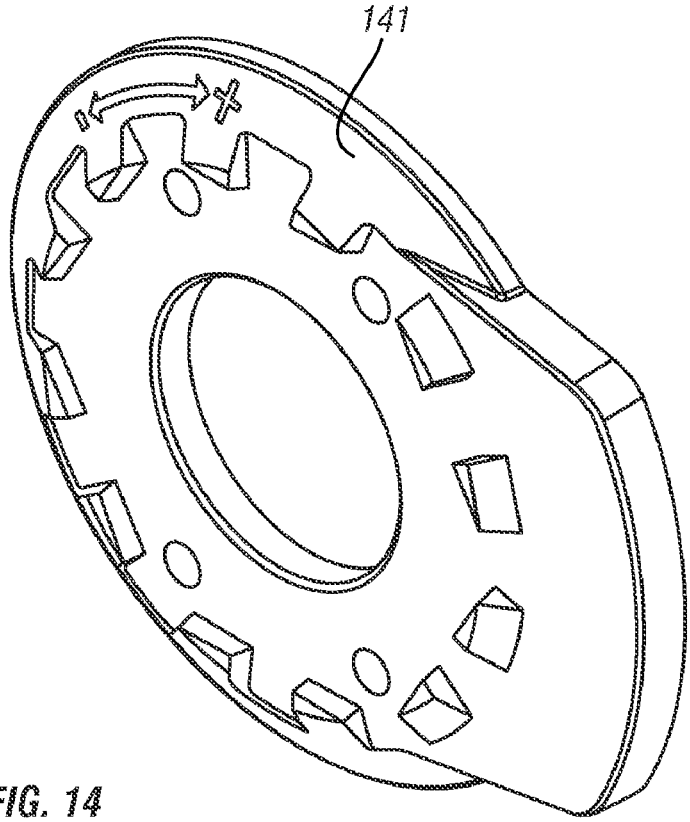
FIG. 14 is a perspective view of a housing part associated with the exercise device of FIG. 10.
Figure 16:
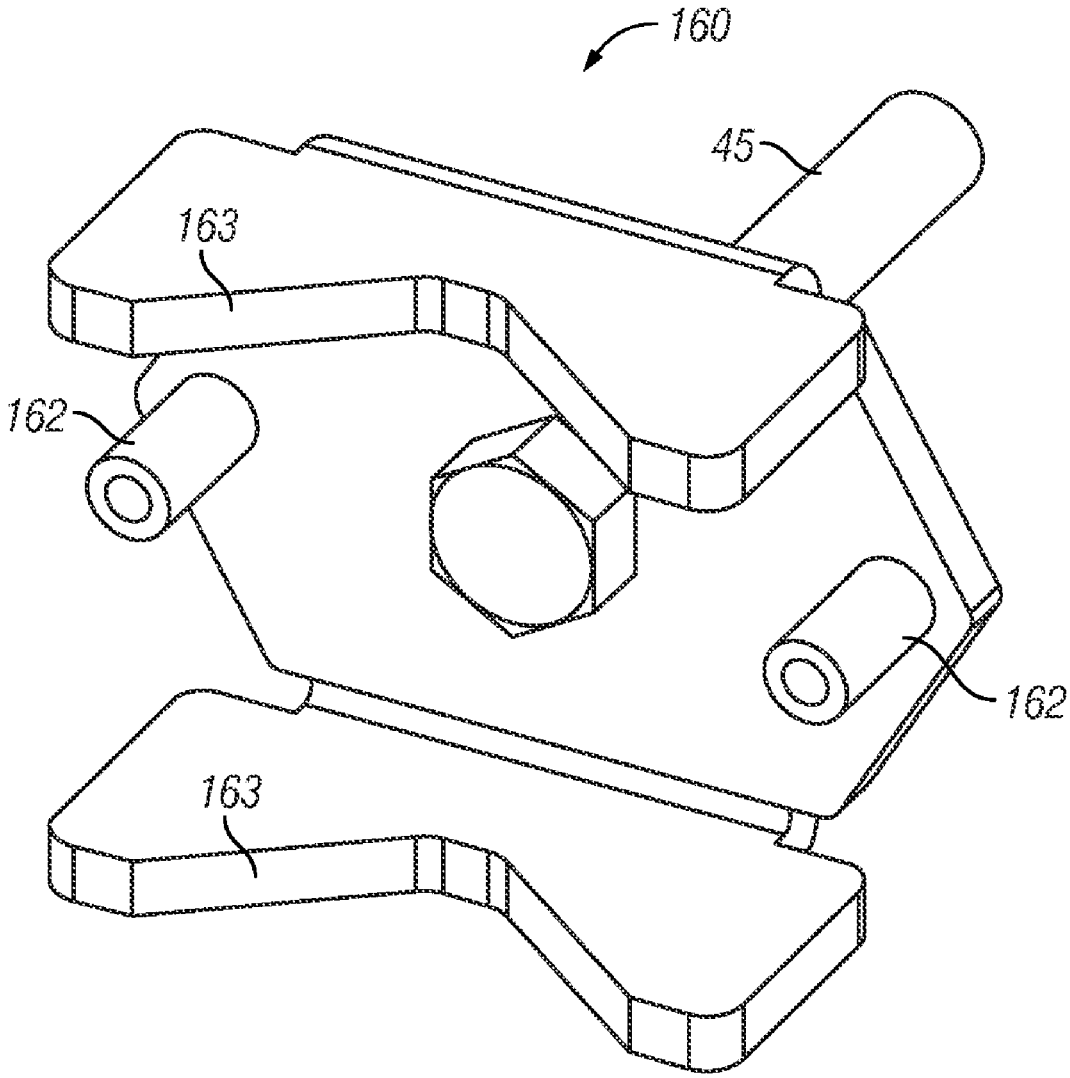
FIG. 16 is a perspective view of a portion of a clamp associated with the exercise device of FIG. 10.
Figure 17:
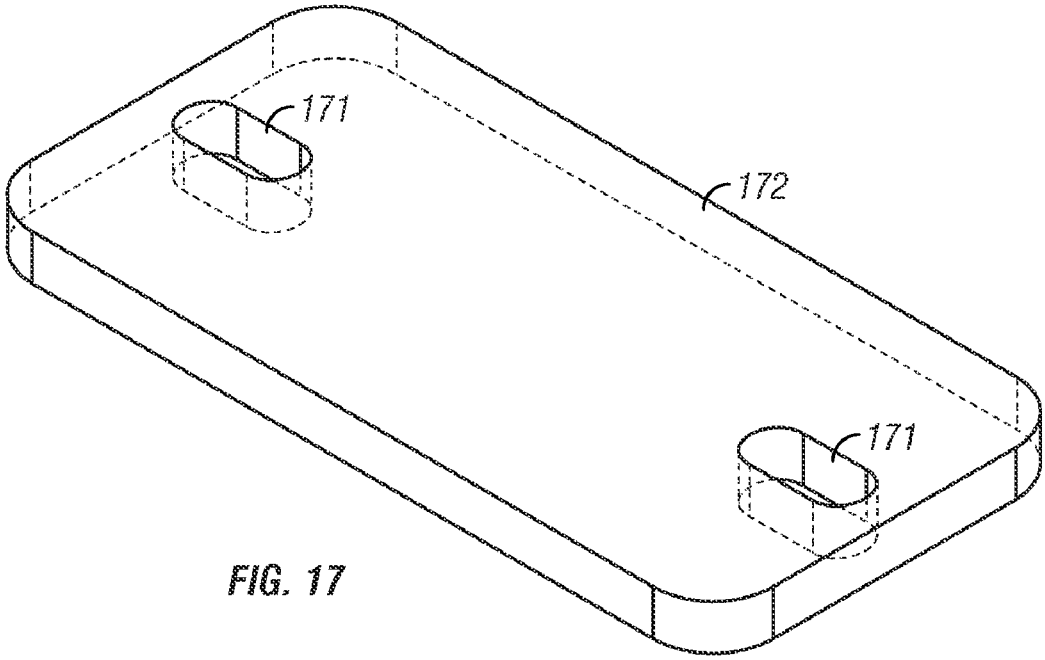
FIG. 17 is a perspective view of another portion of a clamp associated with the exercise device of FIG. 10.
Figure 18:
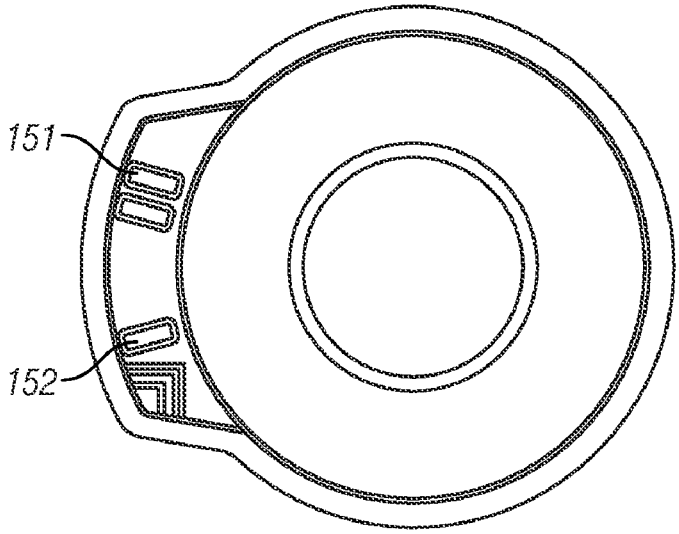
FIG. 18 is a side view of an inner face of a housing part associated with the exercise device of FIG. 10.

Although the embodiment of FIGS. 11-18 has been shown with a clamp configuration according to FIGS. 12 and 16, nevertheless any of the clamp configurations previously described, including but not limited to configurations in FIGS. 3, 5A-5D, and 8, may be employed.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. An exercise apparatus comprising:

a handle bar;

a resistance assembly, coupled to the handle bar, the resistance assembly including a housing having first and second opposed parts, each part having an inner face and an exterior, the resistance assembly permitting rotational movement of the handle bar about a rotational axis upon the application of a force to the handle bar; and a resistance mechanism configured to resist rotational movement of the handle bar about the rotational axis;

a screw, mounted so as to have a long axis coinciding with the rotational axis, and engaging with a threaded receptacle, for adjustably compressing the spacing between the inner faces and modifying resistance of the resistance mechanism to the rotational movement of the handle bar, one of the screw and the receptacle being coupled to an adjustment knob by which may be provided a user-defined resistance setting of the force required to cause rotational movement of the handle bar;

a clamp, coupled to the housing, configured to removably attach the exterior of the first part of the housing to a member that is distinct from the exercise apparatus;

such that a user desirous of exercise can grasp the handle bar and cause motion of the handle bar about the rotational axis by applying to the handle bar the force corresponding to the resistance setting and the clamp can be utilized without operation of the adjustment knob.

2. An exercise apparatus according to claim 1, wherein the adjustment knob is mounted to project from the exterior of the second part of the housing.

3. An exercise apparatus according to claim 1, wherein resistance mechanism includes a plate disposed between the inner faces of the first and second parts and wherein the handle bar is coupled to the plate.

4. An exercise apparatus according to claim 1, wherein the clamp includes an opposed pair of vee blocks, so as to accommodate a range of shapes and dimensions of the member.

5. An exercise apparatus according to claim 1, wherein the clamp includes a pair of opposed blocks, a first one of which is a vee block and a second one of which has a smooth concave shape, so that the blocks together define an aperture in which the member can be clamped, so as to accommodate a range of shapes and dimensions of the member.

6. An exercise apparatus according to claim 5, wherein the vee block has a notch depth that is greater than a concavity depth of the second block.

7. An exercise apparatus according to claim 6, further comprising a hinge connecting the pair of blocks at a first end, and a screw connecting the pair of blocks at a second end.

8. An exercise apparatus according to claim 1, wherein the clamp includes an overcenter latch.

9. An exercise apparatus according to claim 4, further comprising an overcenter latch coupled to hold the pair of vee blocks in place.

10. An exercise apparatus according to claim 4, further comprising a hinge connecting the pair of vee blocks at a first end, and a screw connecting the pair of vee blocks at a second end.

11. An exercise apparatus according to claim 1, wherein the handle bar has a longitudinal axis and includes an axially divergent end portion, and wherein the handle bar is engagable with the second part of the housing over a range of angular orientations about the longitudinal axis, so as to provide a selectable angular orientation of the end portion for being grasped by the user.

12. An exercise apparatus according to claim 11, wherein the handle bar is removably engagable with the resistance assembly.

13. An exercise apparatus comprising:

a housing including first and second opposed parts, each part having an inner face and an exterior;

a clamp, coupled to the housing, configured to removably attach the exterior of the first part of the housing to a member that is distinct from the exercise apparatus;

a plate, disposed between the inner faces of the first and second opposed parts, and mounted for rotation about a rotational axis relative to the first and second parts;

a handle bar, coupled to the plate, that causes the plate to rotate relative to the housing;

a screw, mounted so as to have a longitudinal axis coinciding with the rotational axis, and engaging with a threaded receptacle, for adjustably compressing the inner faces against the plate so as to permit adjustment of resistance offered by the plate against motion relative to the housing; such that a user desirous of exercise can grasp the handle bar and cause the plate to move relative to the housing by applying to the handle bar an amount of force corresponding to the adjustment.

14. An exercise apparatus according to claim 13, wherein the plate comprises a corrosion resistant metal.

15. An exercise apparatus according to claim 13, wherein the plate comprises stainless steel.

16. An exercise apparatus according to claim 13, wherein the inner faces of the opposed parts are composed of plastic.

17. An exercise apparatus according to claim 16, wherein the plastic is a polyoxymethylene.

18. An exercise apparatus according to claim 16, wherein the plastic is a polycarbonate.

19. An exercise apparatus according to claim 13, wherein each of the opposed parts includes an eccentric region, and the eccentric regions include components that are interengaged with one another to prevent motion of the first part relative to the second part.

20. An exercise apparatus according to claim 19, wherein the eccentric regions occupy an angular extent of less than 180 degrees, so as to permit motion of the of the handle bar over a range of at least 180 degrees.

21. An exercise apparatus according to claim 13, further comprising an adjustment knob, coupled to one of the screw and the receptacle, such that adjustment of resistance is achieved by turning the knob.

* * * * *